US008911168B2

(12) United States Patent
Yoshinuma et al.

(10) Patent No.: US 8,911,168 B2
(45) Date of Patent: Dec. 16, 2014

(54) SHEET CUTTING DEVICE WITH RESTRICTION UNIT AND IMAGE FORMING APPARATUS INCLUDING SAME

(71) Applicants: Toshihiro Yoshinuma, Kanagawa (JP); Yuichiro Maeyama, Kanagawa (JP)

(72) Inventors: Toshihiro Yoshinuma, Kanagawa (JP); Yuichiro Maeyama, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 56 days.

(21) Appl. No.: 13/693,200

(22) Filed: Dec. 4, 2012

(65) Prior Publication Data

US 2013/0195536 A1 Aug. 1, 2013

(30) Foreign Application Priority Data

Jan. 31, 2012 (JP) ..... 2012-018419
Jan. 31, 2012 (JP) ..... 2012-018421

(51) Int. Cl.

| | |
|---|---|
| ***B41J 11/70*** | (2006.01) |
| ***B26D 1/24*** | (2006.01) |
| ***B26D 5/02*** | (2006.01) |
| ***B26D 1/18*** | (2006.01) |
| *B26D 7/00* | (2006.01) |

(52) U.S. Cl.

CPC ..... *B41J 11/70* (2013.01); *B41J 11/706* (2013.01); *B26D 1/245* (2013.01); *B26D 5/02* (2013.01); *B26D 2007/005* (2013.01); *B26D 1/185* (2013.01)

USPC ..... 400/621; 83/500; 83/563

(58) Field of Classification Search

CPC ..... B26D 1/185; B26D 1/245

USPC ..... 400/621; 83/500, 501, 502, 536; 346/24; 347/157

See application file for complete search history.

(56) References Cited

U.S. PATENT DOCUMENTS

| | | | | |
|---|---|---|---|---|
| 2009/0226236 | A1 * | 9/2009 | Yamashita et al. | 400/621 |
| 2012/0139987 | A1 | 6/2012 | Maeyama et al. | 347/16 |
| 2012/0140010 | A1 | 6/2012 | Ogawa et al. | 347/104 |
| 2012/0140011 | A1 | 6/2012 | Yamada et al. | 347/104 |
| 2012/0210838 | A1 | 8/2012 | Maeyama et al. | 83/70 |
| 2012/0222530 | A1 | 9/2012 | Yoshinuma et al. | 83/401 |
| 2012/0222531 | A1 | 9/2012 | Ogawa et al. | 83/401 |
| 2012/0222532 | A1 | 9/2012 | Yamada et al. | 83/401 |

FOREIGN PATENT DOCUMENTS

| | | | | |
|---|---|---|---|---|
| JP | 09029685 A * | 2/1997 | | B26D 1/04 |
| JP | 2009-214200 | 9/2009 | | |
| JP | 2012-183603 | 9/2012 | | |

OTHER PUBLICATIONS

U.S. Appl. No. 13/621,218, filed Sep. 15, 2012, Yuichiro Maeyama et al.

* cited by examiner

*Primary Examiner* — Daniel J Colilla
(74) *Attorney, Agent, or Firm* — Cooper & Dunham LLP

(57) ABSTRACT

A sheet cutting device to cut a sheet conveyed through a conveyance path to a predetermined length, including a cutter casing movable in a sheet width direction perpendicular to a sheet conveyance direction while retracted from the sheet conveyance path after cutting of the sheet, a movable member separate from the cutter casing in the sheet conveyance direction and movable in the sheet width direction, a connection member to connect the cutter casing and the movable member, and a restriction unit to transform a state of the cutter casing between a displacement restriction state in which displacement of the cutter casing is restricted during the cutting of the sheet and a released state in which the restriction of displacement of the cutter casing is released while the cutter casing is retracted from the sheet conveyance path.

9 Claims, 15 Drawing Sheets

SHEET CUTTING DEVICE WITH RESTRICTION UNIT AND IMAGE FORMING APPARATUS INCLUDING SAME

CROSS-REFERENCE TO RELATED APPLICATIONS

This patent application is based on and claims priority pursuant to 35 U.S.C. §119 to Japanese Patent Applications No. 2012-018421, filed on Jan. 31, 2012, and No. 2012-018419, filed on Jan. 31, 2012, both in the Japan Patent Office, the entire disclosure of each of which is hereby incorporated by reference herein.

BACKGROUND OF THE INVENTION

1. Field of the Invention

Exemplary aspects of the present invention generally relate to a sheet cutting device that cuts a sheet roll to desired length, and more particularly to a sheet cutting device installed in an image forming apparatus such as a printer, copier, or facsimile machine.

2. Description of the Related Art

Image forming apparatuses are known that feed a sheet of recording media such as paper or the like from a sheet roll, constituted as one long continuous sheet wound around a core, in a predetermined sheet conveyance direction to form an image on the sheet. Such image forming apparatuses generally include a sheet cutting device that cuts the sheet roll to a predetermined length using a cutter traveling laterally in a sheet width direction that is perpendicular to the sheet conveyance direction.

After cutting the sheet roll while moving outward, a cutter unit that holds the cutter therein is moved homeward and returned to its home position to be ready for the next cutting operation. At this time, use of a single path for both outward and homeward movement of the cutter unit may cause cutter jam, in which a sheet that has been already cut from the sheet roll contacts the cutter during the homeward movement of the cutter unit and thus hinders the movement of the cutter unit.

In order to prevent cutter jam, there is known an image forming apparatus including a sheet cutting device in which two separate paths are provided for outward and homeward movement of the cutter unit, respectively. In such a sheet cutting device, a homeward path of the cutter is provided downstream from an outward path thereof in the sheet conveyance direction. After cutting the sheet roll during the outward movement, the cutter travels back to its home position through the homeward path positioned downstream from a new or subsequent leading edge of the sheet roll.

However, in the above-described image forming apparatus, a carriage mounting a recording head thereon and the cutter unit are individually provided side by side in the sheet conveyance direction, resulting in an increase in the size of the image forming apparatus in the sheet conveyance direction. In addition, although the cutter is moved outward and homeward through the two different paths, respectively, the cutter unit itself is still positioned on a sheet conveyance path in order to prevent contact between the sheet that has been already cut and the cutter during the homeward movement. Consequently, the next sheet cannot be conveyed from the sheet roll until the cutter and the cutter unit are returned to the home position, thereby reducing productivity.

In another approach, the carriage and the cutter unit are disposed one above the other in a sheet thickness direction to reduce the size of the image forming apparatus in the sheet conveyance direction. In addition, compared to the outward path of the cutter unit, the homeward path thereof is retracted from the sheet conveyance path in the sheet thickness direction so that the cutter unit after cutting of the sheet roll is movable homeward while being retracted from the sheet conveyance path.

In the above-described configuration, a cutter casing that accommodates the cutter is pulled in the sheet width direction by a movable member to cut a sheet from the sheet roll. After cutting of the sheet roll, the cutter casing is rotated relative to the movable member to retract the cutter unit from the sheet conveyance path. However, any clearance, or parts tolerance, between a rotary shaft of the cutter casing and a bearing hole of the rotary shaft or slight movement of the cutter casing relative to the rotary shaft in a thrust direction may displace the cutter casing during cutting of the sheet roll due to cutting load, resulting in improper cutting of the sheet roll.

One conceivable way to prevent the displacement of the cutter casing during the cutting of the sheet roll is to reduce the clearance between the rotary shaft of the cutter casing and the bearing hole of the rotary shaft to fix the relative positions of the cutter casing and the rotary shaft. However, firm fixing of the relative positions of the cutter casing and the rotary shaft increases the load during rotation of the cutter casing.

SUMMARY OF THE INVENTION

In view of the foregoing, illustrative embodiments of the present invention provide a novel sheet cutting device that prevents displacement of a cutter casing during cutting of a sheet roll and reduces load during rotation of the cutter casing, and an image forming apparatus including the sheet cutting device.

In one illustrative embodiment, a sheet cutting device to cut a sheet conveyed through a conveyance path to a predetermined length includes a cutter casing movable in a sheet width direction perpendicular to a sheet conveyance direction while retracted from the sheet conveyance path in a sheet thickness direction after cutting of the sheet and accommodating a pair of blades disposed opposite each other with the sheet interposed therebetween, a movable member separate from the cutter casing in the sheet conveyance direction and movable in the sheet width direction, a connection member to connect the cutter casing and the movable member and having a central axis around which the cutter casing is rotated relative to the movable member in the sheet thickness direction, and a restriction unit to transform a state of the cutter casing based on rotation of the cutter casing between a displacement restriction state in which displacement of the cutter casing is restricted during the cutting of the sheet and a released state in which the restriction of displacement of the cutter casing is released while the cutter casing is retracted from the sheet conveyance path in the sheet thickness direction.

In another illustrative embodiment, a sheet cutting device to cut a sheet conveyed through a conveyance path to a predetermined length includes a cutter casing accommodating a pair of blades disposed opposite each other with the sheet interposed therebetween, a movable member separate from the cutter casing in a sheet conveyance direction and movable in a sheet width direction perpendicular to the sheet conveyance direction, a connection member to connect the cutter casing and the movable member and having a central axis around which the cutter casing is rotated relative to the movable member in a sheet thickness direction, and a restriction unit to restrict displacement of the cutter casing during operation.

In yet another illustrative embodiment, an image forming apparatus includes an image forming unit to form an image on a sheet, the sheet cutting device described above disposed downstream from the image forming unit in the sheet conveyance direction to cut the sheet having an image formed by the image forming unit thereon to a predetermined length, and a sheet conveyance unit to convey the sheet having the image thereon to the sheet cutting device through the sheet conveyance path.

Additional features and advantages of the present disclosure will become more fully apparent from the following detailed description of illustrative embodiments, the accompanying drawings, and the associated claims.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION OF THE INVENTION

Figure 1:
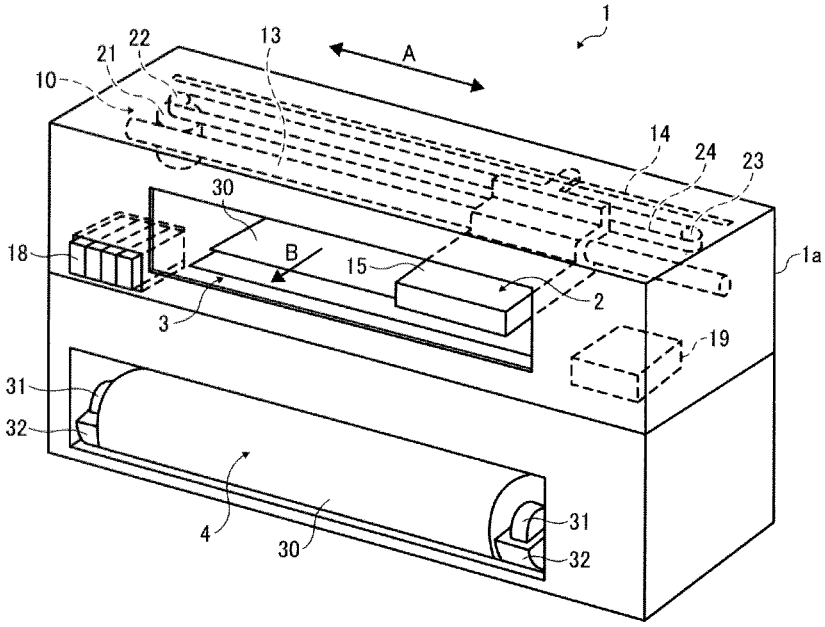
FIG. 1 is a perspective view illustrating an example of a configuration of an image forming apparatus according to an illustrative embodiment.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Illustrative embodiments of the present invention are now described below with reference to the accompanying drawings. In a later-described comparative example, illustrative embodiment, and exemplary variation, for the sake of simplicity the same reference numerals will be given to identical constituent elements such as parts and materials having the same functions, and redundant descriptions thereof omitted unless otherwise required.

Figure 2:
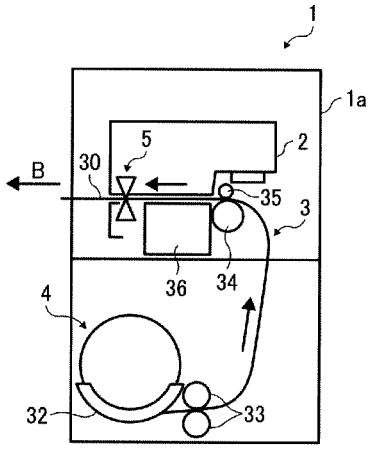
FIG. 2 is a vertical cross-sectional view illustrating the configuration of the image forming apparatus illustrated in FIG. 1.

A description is now given of a configuration and operation of an image forming apparatus 1 according to an illustrative embodiment with reference FIGS. 1 and 2.

FIG. 1 is a perspective view illustrating an example of a configuration of the image forming apparatus 1 according to the illustrative embodiment. FIG. 2 is a vertical cross-sectional view illustrating the configuration of the image forming apparatus 1.

The image forming apparatus 1 is a serial-type inkjet recording device in which a recording head ejects ink droplets while moving laterally in a width direction of a recording medium such as a sheet of paper, which remains stationary, to form a single line of an image to be formed on the sheet. After the recording head scans reciprocally back and forth across the sheet once or multiple times, the sheet is conveyed by a predetermined amount so that the next line of the image is formed on the sheet. It is to be noted that the illustrative embodiment described herein is applicable not only to the serial-type inkjet recording device but also to a line-type inkjet recording device equipped with a line-type recording head having multiple nozzles arrayed laterally across the sheet that ejects ink droplets while remaining stationary to form an image on the sheet while the sheet is conveyed.

The image forming apparatus 1 includes an image forming unit 2, a sheet conveyance unit 3, a sheet roll storage unit 4, and a sheet cutting device 5, each of which is accommodated within a body 1*a* of the image forming apparatus 1.

In the image forming unit 2, a carriage 15 is slidably held in a main scanning direction, which is indicated by arrow A in FIG. 1 and subsequent drawings, by a guide rod 13 and a guide rail 14, each extended between lateral plates of the image forming apparatus 1. The carriage 15 is reciprocally movable back and forth on the guide rod 13 and the guide rail 14 in the main scanning direction while contacting the guide rod 13 and the guide rail 14.

Recording heads that eject ink droplets of a specific color, that is, black (K), yellow (Y), magenta (M), or cyan (C), are mounted on the carriage 15. A sub-tank that supplies ink to the recording heads is formed together with each of the recording heads as a single integrated unit.

A main scanning mechanism 10 scans the carriage 15 reciprocally back and forth across a recording medium such as a sheet of paper in a sheet width direction, that is, the main scanning direction. The main scanning mechanism 10 includes a drive motor 21 provided at one end of the image forming unit 2 in the sheet width direction, a drive pulley 22 rotatively driven by the drive motor 21, a driven pulley 23 provided at the other end of the image forming unit 2 in the sheet width direction, and a belt member 24 wound around the drive pulley 22 and the driven pulley 23. A tension spring, not shown, applies tension to the driven pulley 23 outward, that is, in a direction away from the drive pulley 22. A part of the belt member 24 is fixed to a mount, not shown, provided on a back surface of the carriage 15 to pull the carriage 15 in the sheet width direction.

An encoder sheet, not shown, is provided along the sheet width direction to detect a main scanning position of the carriage 15. The encoder sheet is read by an encoder sensor, not shown, provided on the carriage 15 to detect the main scanning position of the carriage 15.

The carriage 15 has a main scanning range through which it scans, and within this range is a recording range. A sheet fed from a sheet roll 30 set in the sheet roll storage unit 4 is intermittently conveyed to the recording range by the sheet conveyance unit 3 in a sheet conveyance direction indicated by arrow B in FIG. 1 and subsequent drawings. The sheet conveyance direction is perpendicular to the sheet width direction.

A main cartridge 18 that stores ink of the specified colors to be supplied to the respective sub-tanks included in the recording heads of the carriage 15 is detachably attached to the body 1*a* of the image forming apparatus 1 at a portion outside the main scanning range of the carriage 15 in the sheet width direction or at one end of the main scanning range of the carriage 15. A maintenance/recovery mechanism 19 that performs maintenance and recovery of the recording heads is provided at the other end of the main scanning range of the carriage 15.

A sheet roll 30 on which an image is formed is set in the sheet roll storage unit 4 that feeds a sheet from the sheet roll 30. It is to be noted that the reference numeral 30 is hereinafter used also to denote a sheet fed from the sheet roll 30. The sheet roll storage unit 4 can accommodate a sheet roll of various sizes in the sheet width direction. Flanges 31 attached to both ends of a paper core of the sheet roll 30 are placed on flange receivers 32, respectively, so that the sheet roll 30 is set in the sheet roll storage unit 4. Support rollers, not shown, provided inside the flange receivers 32 contact outer circumferential surfaces of the flanges 31, respectively, thereby rotating the flanges 31 to feed the sheet 30 to a sheet conveyance path.

The sheet conveyance unit 3 includes a pair of sheet feed rollers 33, a registration roller 34, a registration pressing roller 35, and a sheet suction mechanism 36. The pair of sheet feed rollers 33 feeds the sheet 30 to the sheet conveyance path from the sheet roll storage unit 4. The registration roller 34 and the registration pressing roller 35 are provided below the image forming unit 2 to convey the sheet 30 to the sheet cutting device 5 via the image forming unit 2.

The sheet suction mechanism 36 is provided opposite and below the image forming unit 2 to attract the sheet 30 to a platen plate provided to an upper surface of the sheet suction mechanism 36, thereby flattening the sheet 30 conveyed below the image forming unit 2.

The sheet 30 fed from the sheet roll storage unit 4 by the pair of sheet feed rollers 33 is conveyed through the sheet conveyance path from the back to the front of the image forming apparatus 1 by the sheet conveyance unit 3 to reach the recording range of the carriage 15 positioned below the image forming unit 2. When the sheet 30 is conveyed to the recording range, the carriage 15 is moved reciprocally back and forth in the sheet width direction and the recording heads eject ink droplets based on image data while the sheet 30 is intermittently conveyed. As a result, a desired image based on the image data is formed on the sheet 30.

The sheet 30 having the image formed thereon is then cut to a predetermined length by the sheet cutting device 5 and is discharged to a discharge tray, not shown, provided on the front side of the image forming apparatus 1, by a discharge roller.

Figure 3:
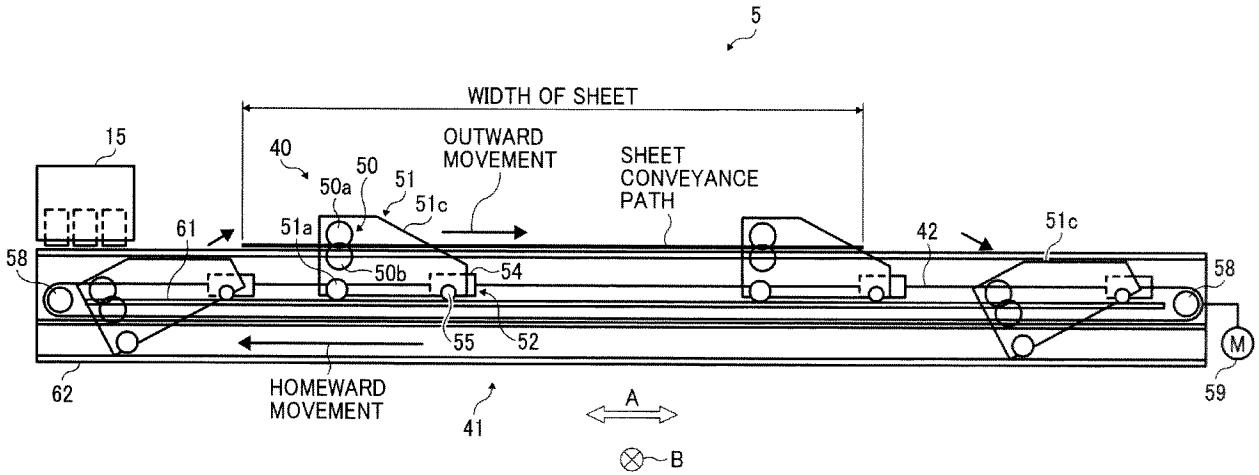
FIG. 3 is a rear view illustrating an example of a configuration of a sheet cutting device included in the image forming apparatus.
Figure 4A:
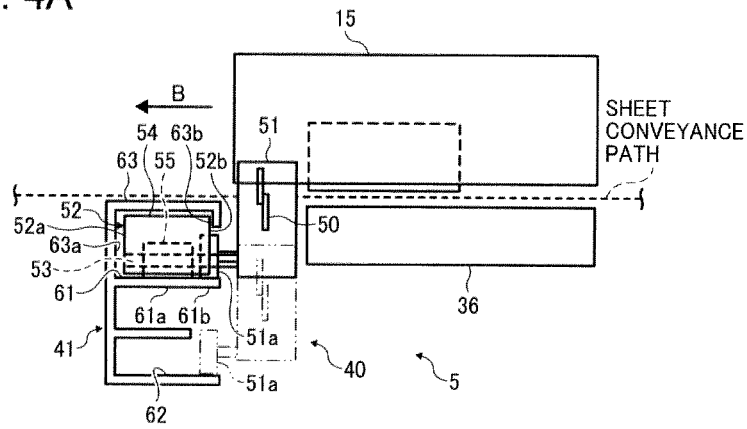
FIG. 4A is a partial vertical cross-sectional view illustrating the configuration of the sheet cutting device.
Figure 4B:
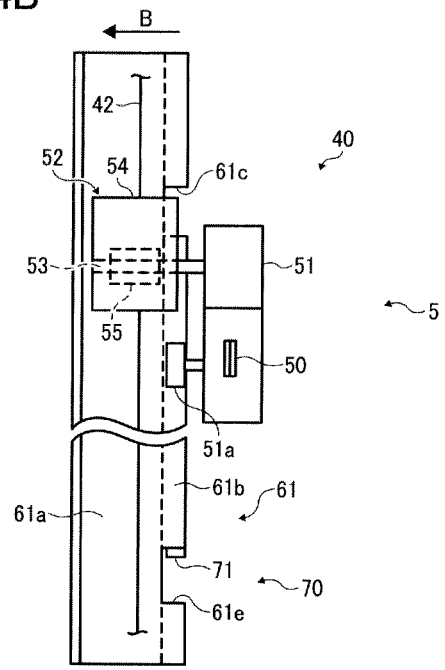
FIG. 4B is a partial plan view illustrating the configuration of the sheet cutting device.
Figure 5:
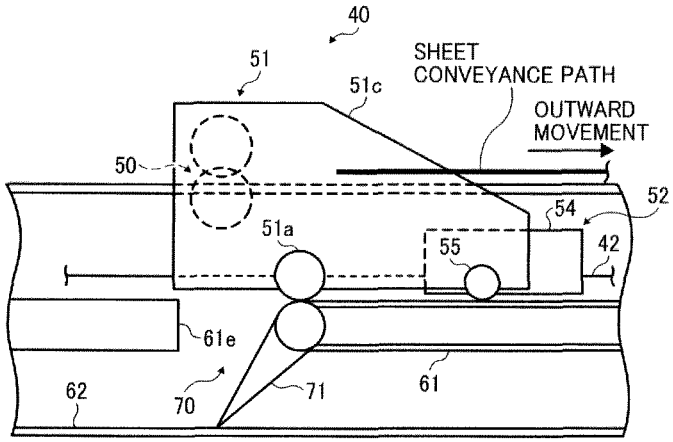
FIG. 5 is a schematic view illustrating a state in which a cutter casing included in the sheet cutting device is returned to a cutting range.
Figure 6:
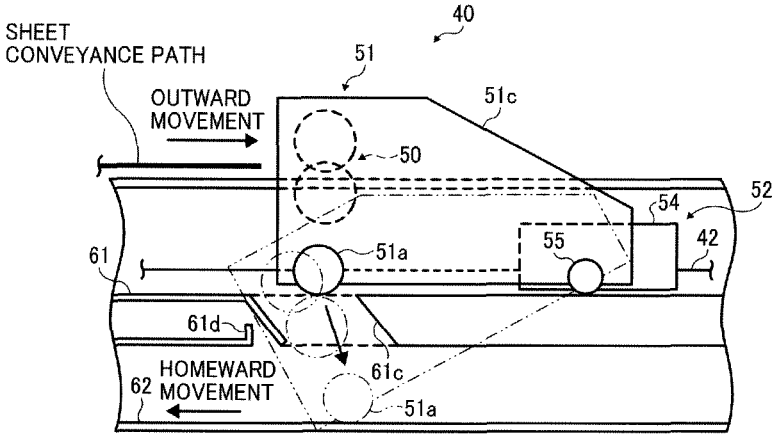
FIG. 6 is a schematic view illustrating operation of the cutter casing upon transition to homeward movement.
Figure 7:
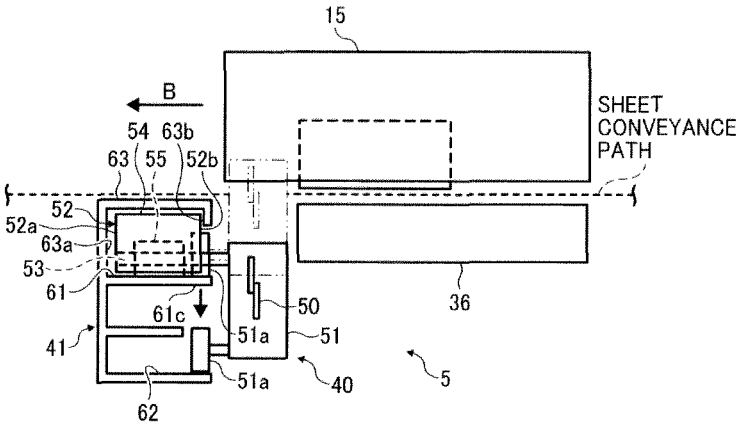
FIG. 7 is a partial vertical cross-sectional view illustrating the cutter casing during the homeward movement.
Figure 8:
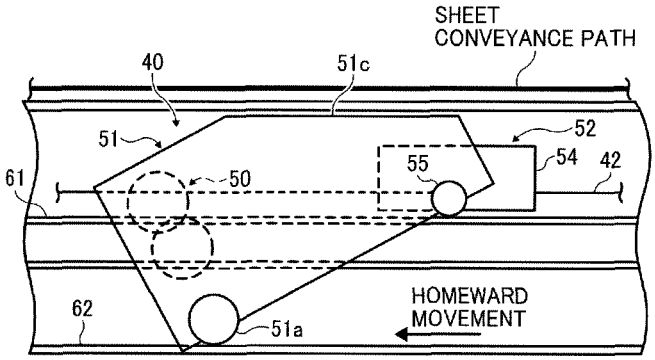
FIG. 8 is a schematic view illustrating the cutter casing during the homeward movement.
Figure 9:
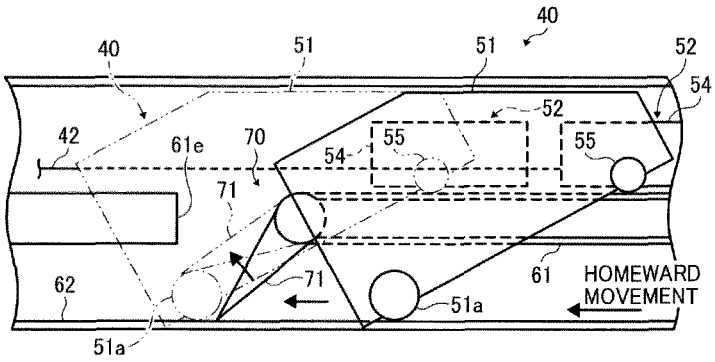
FIG. 9 is a schematic view illustrating operation of the cutter casing upon return to the home position.
Figure 10:
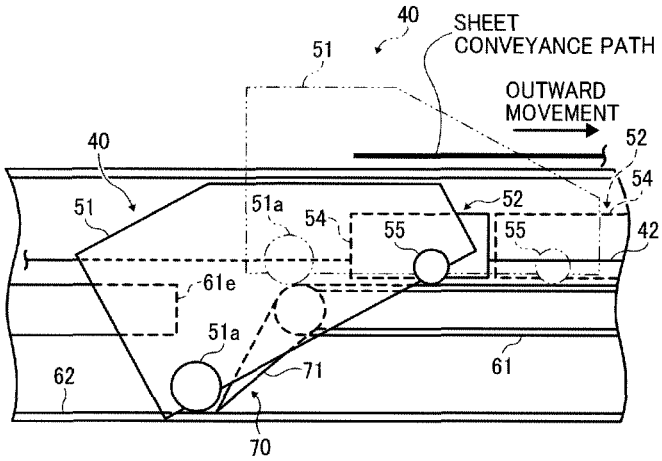
FIG. 10 is a schematic view illustrating operation of the cutter casing upon return to the cutting range.

A description is now given of a configuration and operation of the sheet cutting device 5 according to the illustrative embodiment with reference to FIGS. 3 to 10. FIG. 3 is a rear view illustrating an example of a configuration of the sheet cutting device 5. FIG. 4A is a partial vertical cross-sectional view illustrating the configuration of the sheet cutting device 5. FIG. 4B is a partial plan view illustrating the configuration of the sheet cutting device 5. FIG. 5 is a schematic view illustrating a state in which a cutter casing 51 included in the sheet cutting device 5 is returned to a cutting range. FIG. 6 is a schematic view illustrating operation of the cutter casing 51 upon transition to homeward movement. FIG. 7 is a partial vertical cross-sectional view illustrating the cutter casing 51 during the homeward movement. FIG. 8 is a schematic view illustrating the cutter casing 51 during the homeward movement FIG. 9 is a schematic view illustrating operation of the cutter casing 51 upon return to the home position. FIG. 10 is a schematic view illustrating operation of the cutter casing 51 upon return to the cutting range.

The sheet cutting device 5 is disposed in a downstream part of the image forming unit 2 in the sheet conveyance direction and includes a cutter unit 40, a guide member 41, and a wire 42. The sheet cutting device 5 cuts the sheet 30 conveyed through the sheet conveyance path to a predetermined length.

The cutter unit 40 includes a cutter assembly 50, the cutter casing 51 that accommodates the cutter assembly 50, a movable member 52, and a connection member, which, in the present illustrative embodiment, is a rotary shaft 53.

The cutter assembly 50 is constructed of a pair of circular blades 50*a* and 50*b* disposed opposite each other with the sheet 30 interposed therebetween, and is rotatably held within the cutter casing 51. The circular blades 50*a* and 50*b* are rotated by a drive force as the cutter casing 51 moves in the sheet width direction, that is, the main scanning direction. The circular blades 50*a* and 50*b* cut the sheet 30 while rotating, and therefore a relatively thick sheet can also be cut by the cutter assembly 50. Because the cutter assembly 50 is constructed of the circular blades 50*a* and 50*b* as described above, differing from a fixed blade, abrasion of a concentrated part of the circular blade 50*a* or 50*b* can be prevented. It is to be noted that, alternatively, the cutter assembly 50 may be constructed of a single circular blade or three or more circular blades. In a case in which the cutter assembly 50 is constructed of the single circular blade, it is preferable that a fixed linear blade extending in a direction of movement of the cutter assembly 50 be separately provided. In the present illustrative embodiment, the circular blades 50*a* and 50*b* together form the blade of the sheet cutting device 5.

The cutter casing 51 is connected to the movable member 52 via the rotary shaft 53 and is moved by the movable member 52 reciprocally back and forth laterally across the sheet 30 in the sheet width direction. In addition, the cutter casing 51 is rotatable relative to the movable member 52 around the rotary shaft 53 in a sheet thickness direction. Specifically, the cutter casing 51 is rotatable both normally and reversely within a predetermined range or angle.

During outward movement of the cutter casing 51 from the other end to the one end of the image forming apparatus 1 in FIG. 1, the cutter assembly 50 cuts the sheet 30. By contrast, during homeward movement of the cutter casing 51 from the one end to the other end of the image forming apparatus 1 to return to its home position, the cutter casing 51 is retracted downward from the sheet conveyance path in the sheet thickness direction by rotating downward relative to the movable member 52. Thus, after cutting the sheet 30, the cutter casing 51 is moved in the sheet width direction while being retracted from the sheet conveyance path in the sheet thickness direction. As a result, the cutter casing 51 is separated from the sheet conveyance path during the homeward movement thereof so that the sheet conveyance path is not blocked by the cutter casing 51. The cutter casing 51 is rotated upward relative to the movable member 52 upon transition to the outward movement from the homeward movement.

A detector such as a microswitch, not shown, provided at both ends of the guide member 41 in the sheet width direction detects the position of the cutter casing 51, and the position of the cutter casing 51 is controlled based on the result detected by the microswitch.

A driven roller 51*a* is provided to an upstream part of the cutter casing 51 in a direction of movement of the cutter casing 51 during cutting of the sheet 30 (hereinafter simply referred to as the cutting direction).

The driven roller 51*a* is rotatably provided apart from a drive roller 55, which is described in detail later, in the sheet width direction. During the outward movement of the cutter casing 51, the driven roller 51*a* is moved on an upper guide rail 61 included in the guide member 41. During the homeward movement of the cutter casing 51, the driven roller 51*a* is moved on a lower guide rail 62 included in the guide member 41. In other words, the driven roller 51*a* positions the cutter casing 51 relative to the upper or lower guide rail 61 or 62 during the reciprocal movement of the cutter casing 51. It is to be noted that, in place of the driven roller 51*a*, an arc-shaped protrusion may be used for positioning the cutter casing 51.

The movable member 52 is provided apart from the cutter casing 51 in the sheet conveyance direction and includes a body 54 and the drive roller 55. The movable member 52 is moved in the sheet width direction within a range of movement extending across the body 1*a* of the image forming apparatus 1.

The drive roller 55 is formed of rubber and fixed to the rotary shaft 53 to be rotated together with the rotary shaft 53. Therefore, the drive roller 55 is rotatably held by the body 54 of the movable member 52 via the rotary shaft 53.

The movable member 52 is connected to the wire 42 wound around a pair of pulleys 58 provided at both ends of the body 1*a* of the image forming apparatus 1 in the sheet width direction. A drive motor 59 is connected to one of the pair of pulleys 58 provided at the one end of the body 1*a* of the image forming apparatus 1. The wire 42 is rotatively moved in the sheet width direction by the one of the pair of pulleys 58 rotated by the drive motor 59 to transmit a tractive force to the movable member 52. As a result, the movable member 52 is pulled in the sheet width direction by the wire 42. The drive roller 55 is rotatively driven on the upper guide rail 61 by the rotation of the wire 42. A detailed description of the configuration of the movable member 52 is given later.

Upon transition of the cutter casing 51 between the outward and homeward movement, the cutter casing 51 is rotated in the vertical direction around the rotary shaft 53 of the drive roller 55. Such a configuration allows the cutter casing 51 to cut the sheet 30 during the outward movement and be retracted from the sheet conveyance path during the homeward movement.

The drive roller 55 and the driven roller 51*a* are offset from each other in the sheet conveyance direction as shown in FIGS. 4A, 4B, and 7. Specifically, the driven roller 51*a* is disposed upstream from the drive roller 55 in the sheet conveyance direction. Accordingly, the driven roller 51*a* can be moved between the upper guide rail 61 and the lower guide rail 62 while the drive roller 55 is kept on the upper guide rail 61, thereby achieving rotation of the cutter casing 51 described above. Although being disposed within the width of the carriage 15 in the sheet conveyance direction in the above-described example as illustrated in FIG. 4A, alternatively, the cutter casing 51 may be disposed upstream or downstream from the carriage 15 in the sheet conveyance direction.

The cutter casing 51 further includes a sloped portion 51*c* sloping at a predetermined angle in the vertical direction relative to the sheet conveyance path. The angle of the sloped portion 51*c* is set such that the sloped portion 51*c* is parallel to a virtual plane of the sheet conveyance path during the homeward movement of the cutter casing 51.

Figure 11A:
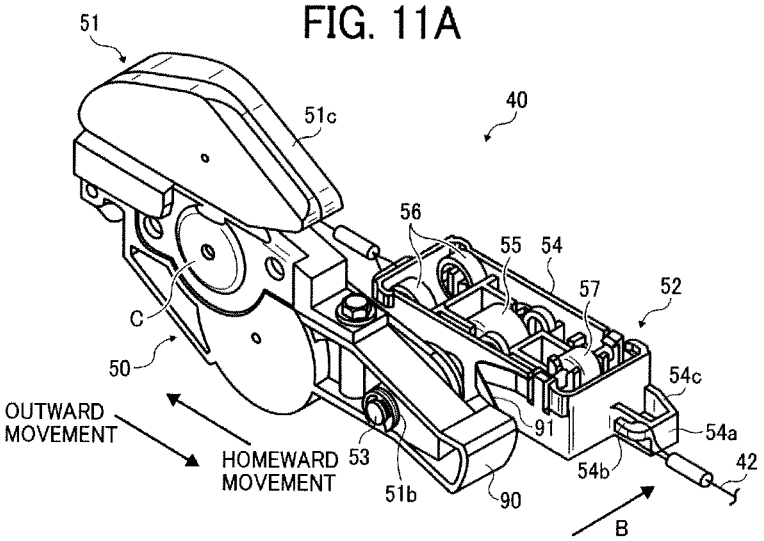
FIG. 11A is a rear perspective view of the cutter casing and a movable member.
Figure 11B:
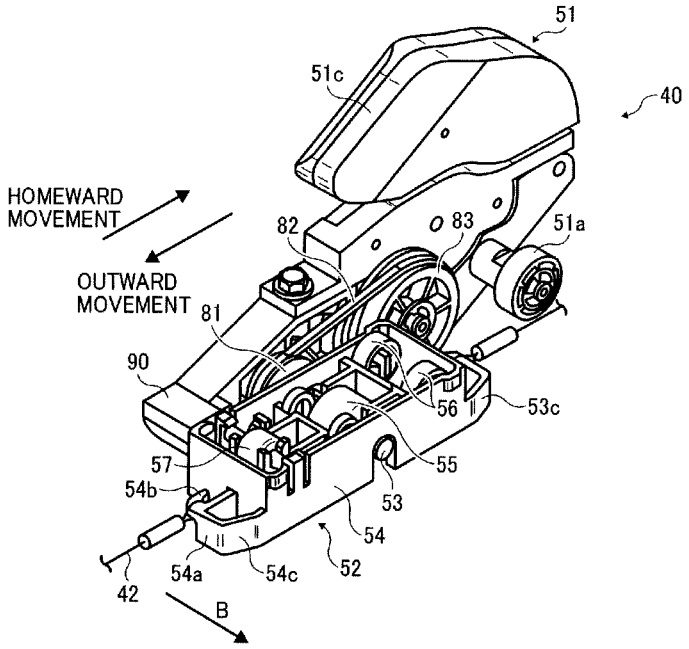
FIG. 11B is a front perspective view of the cutter casing and the movable member.

The rotary shaft 53 connects the cutter casing 51 and the movable member 52 and has a central axis O (shown in FIG. 15 described later) around which the cutter casing 51 is rotated relative to the movable member 52 in the sheet thickness direction. The drive roller 55 is fixed to the downstream end of the rotary shaft 53 in the sheet conveyance direction to be rotated together with the rotary shaft 53. The upstream end of the rotary shaft 53 is rotatably held by a bearing 51*b* of the cutter casing 51 described in detail later with reference to FIG. 11A.

The guide member 41 guides the movable member 52 in the sheet width direction and includes the upper guide rail 61 extending laterally longer than the sheet roll 30 in the sheet width direction and the lower guide rail 62 below the sheet conveyance path. The upper guide rail 61 is disposed below the movable member 52. The guide member 41 further includes an upper guide plate 63 disposed above the upper guide rail 61 and the movable member 52. An outward path of the cutter casing 51 is formed on the upper guide rail 61 and a homeward path of the cutter casing 51 is formed on the lower guide rail 62. Therefore, during the outward movement of the cutter casing 51, the driven roller 51*a* is moved on the upper guide rail 61, and during the homeward movement of the cutter casing 51 after the cutting of the sheet 30, the driven roller 51*a* is moved on the lower guide rail 62. Although being formed together as a single integrated unit in the above-described example, alternatively, the upper guide rail 61 and the lower guide rail 62 may be formed individually as separate members.

The upper guide rail 61 has a drive roller guide range 61*a* that guides the drive roller 55 in the sheet width direction and a driven roller guide range 61*b* that guides the driven roller 51*a* during the outward movement of the cutter casing 51. The drive roller guide range 61*a* and the driven roller guide range 61*b* are parallel to each other in the sheet conveyance direction. Although being formed together in the upper guide rail 61 in the above-described example, alternatively, the drive roller guide range 61*a* and the driven roller guide range 61*b* may be formed individually as separate rails.

A first passage 61*c* through which the cutter casing 51 is moved from the outward path to the homeward path is formed at one end of the driven roller guide range 61*b* in the sheet width direction. As illustrated in FIG. 6, the first passage 61*c* is formed in the upper guide rail 61 to connect the outward path formed on the upper guide rail 61 and the homeward path formed on the lower guide rail 62. Specifically, a cutout is formed in a predetermined portion at one end of the upper guide rail 61 in the sheet width direction and an edge of the cutout is folded downward at a slant of a predetermined angle to form the first passage 61*c*. As a result, the driven roller 51*a* can be moved from the upper guide rail 61 to the lower guide rail 62 after cutting of the sheet 30. A bottom end 61*d* of the upper guide rail 61 adjacent to the first passage 61*c* is folded upward in order to prevent contact with the driven roller 51*a* during the homeward movement of the cutter casing 51.

As illustrated in FIG. 5, a transition mechanism 70 is provided at the other end of the driven roller guide range 61*b* in the sheet width direction. The transition mechanism 70 moves the driven roller 51*a* from the lower guide rail 62 to the upper guide rail 61 so as to return the cutter casing 51 to the cutting range when the cutter casing 51 is moved from the home position to the opposite side in the sheet width direction.

The transition mechanism 70 is constructed of a second passage 61*e* that connects the homeward path formed on the lower guide rail 62 and the outward path formed on the upper guide rail 61, and a switching pawl 71 provided to the upper guide rail 61 at a portion adjacent to the second passage 61*e*.

A cutout is formed in a predetermined portion at the other end of the upper guide rail 61 in the sheet width direction to form the second passage 61*e*.

The switching pawl 71 is normally and reversely rotatable within a predetermined angle between the homeward path and the second passage 61*e*, and is constantly biased downward by a biasing member such as a coil spring, not shown, such that a leading end of the switching pawl 71 contacts the lower guide rail 62. During the homeward movement of the cutter casing 51 to the other end in the sheet width direction, the switching pawl 71 is contacted by the driven roller 51*a* and thus rotated upward against the biasing force of the biasing member as indicated by the broken line in FIG. 9. When the driven roller 51*a* reaches the other end in the sheet width direction, the switching pawl 71 is separated from the driven roller 51*a* and is returned to its original position by the biasing member as shown in FIG. 10. The switching pawl 71 is slanted at a predetermined angle at its original position. Accordingly, upon transition of the cutter casing 51 from the homeward movement to the outward movement, the driven roller 51*a* can be moved from the lower guide rail 62 to the upper guide rail 61 via the switching pawl 71. It is to be noted that the switching pawl 71 may be constructed of a leaf spring. In such a case, provision of the biasing member is not needed.

During the homeward movement of the cutter casing 51, the lower guide rail 62 guides the driven roller 51*a*.

The upper guide plate 63 has a first guide surface 63*a* and a second guide surface 63*b* provided opposite a pair of lateral surfaces 52*a* and 52*b* of the movable member 52, respectively. One end of the upper guide plate 63 in the sheet conveyance direction is folded downward in an L-shape to form the first guide surface 63*a* integrally connected to the upper guide rail 61. Although being formed together via the first guide surface 63*a* as a single integrated member in the above-described example, alternatively, the upper guide plate 63 and the upper guide rail 61 may be formed individually as separate members.

The other end of the upper guide plate 63 is folded downward in an L-shape to form the second guide surface 63*b* extending downward to a certain length such that contact portions 54*d* of the movable member 52 described later with reference to FIG. 14 can contact the second guide surface 63*b*.

A description is now given of operation of the sheet cutting device 5 with reference to FIGS. 5 to 10.

Before the cutting operation, the cutter casing 51 is located at the home position at the other end of the image forming apparatus 1 in the sheet width direction as indicated by the solid line in FIG. 10. Upon receipt of an instruction to cut the sheet 30, the drive roller 55 is rotatively driven via the wire 42 to move the cutter casing 51 from the home position to the cutting range as indicated by the broken line in FIG. 10, and thereafter, the cutter casing 51 is moved through the outward path to the one end of the image forming apparatus 1 in the sheet width direction. During the outward movement of the cutter casing 51, the sheet 30 is cut by the cutter assembly 50.

Cutting of the sheet 30 is completed when the cutter casing 51 passes across the sheet conveyance path to reach the one end of the image forming apparatus 1 in the sheet width direction. Then, the cutter casing 51 is rotated downward around the rotary shaft 53 of the drive roller 55 by its own weight to switch the movement thereof from the outward movement to the homeward movement. Specifically, when the driven roller 51*a* moving on the upper guide rail 61 reaches the first passage 61*c*, the driven roller 51*a* is moved from the upper guide rail 61 to the lower guide rail 62 via the first passage 61*c*. At this time, only the driven roller 51*a* is moved to the lower guide rail 62 by the weight of the cutter casing 51 while the drive roller 55 is remaining on the upper guide rail 61. As a result, the cutter casing 51 positioned in the sheet conveyance path is rotated and retracted from the sheet conveyance path as indicated by the broken line in FIG. 6 to be ready for moving homeward.

Thereafter, the wire 42 is reversely rotated based on the position of the cutter casing 51 detected by the microswitch provided at the one end of the guide member 41 in the sheet width direction so that the drive roller 55 is rotated in a direction opposite the direction of rotation during the outward movement. Accordingly, the cutter casing 51 retracted from the sheet conveyance path is moved to the other end in the sheet width direction through the homeward path as illustrated in FIG. 8. At this time, the cutter casing 51 is retracted downward from the sheet conveyance path so that the sloped surface 51*c* of the cutter casing 51 is parallel to the plane of the sheet conveyance path. Therefore, the sheet conveyance path is not blocked by the cutter casing 51*c* and the sheet 30 can be fed through the sheet conveyance path even during the homeward movement of the cutter casing 51, thereby improving the productivity. In addition, the cutter assembly 50 can be prevented from contacting the sheet 30 which has already been cut from the sheet roll 30, thereby preventing cutter jam.

When the cutter casing 51 is moved near the transition mechanism 70 during the homeward movement, the driven roller 51*a* contacts and pushes the switching pawl 71 upward while moving from the right to the left in FIG. 9 toward the second passage 61*e*. When the driven roller 51*a* reaches the second passage 61e, the switching pawl 71 is separated from the driven roller 51*a* and is returned to its original position by the biasing member as illustrated in FIG. 10.

Thus, a series of reciprocal movements of the cutter casing 51 in the sheet width direction is completed. The above-described series of reciprocal movements of the cutter casing 51 is repeated in a case in which the subsequent sheet 30 is further fed.

Figure 12:
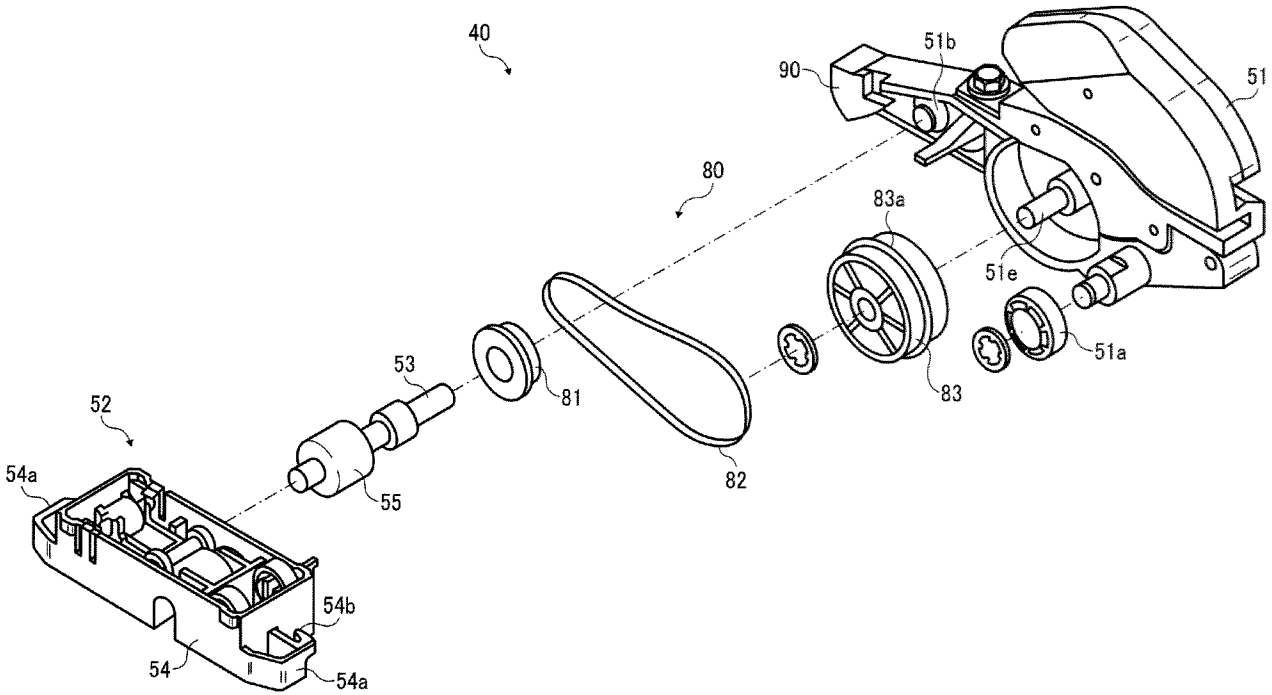
FIG. 12 is an exploded perspective view of the cutter casing and the movable member.
Figure 13:
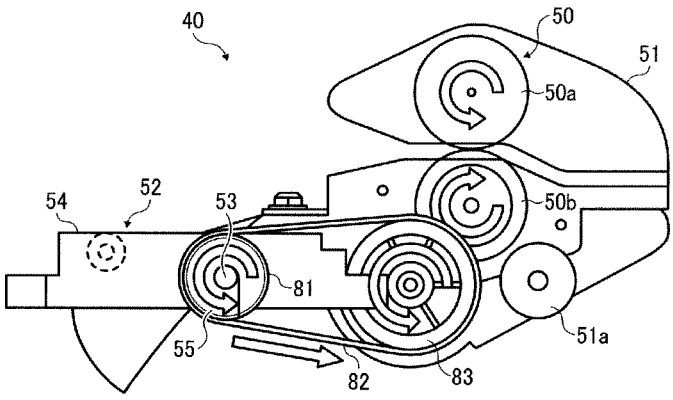
FIG. 13 is a schematic view illustrating transmission of torque from a drive roller provided to the movable member to a cutter assembly accommodated in the cutter casing.
Figure 14:
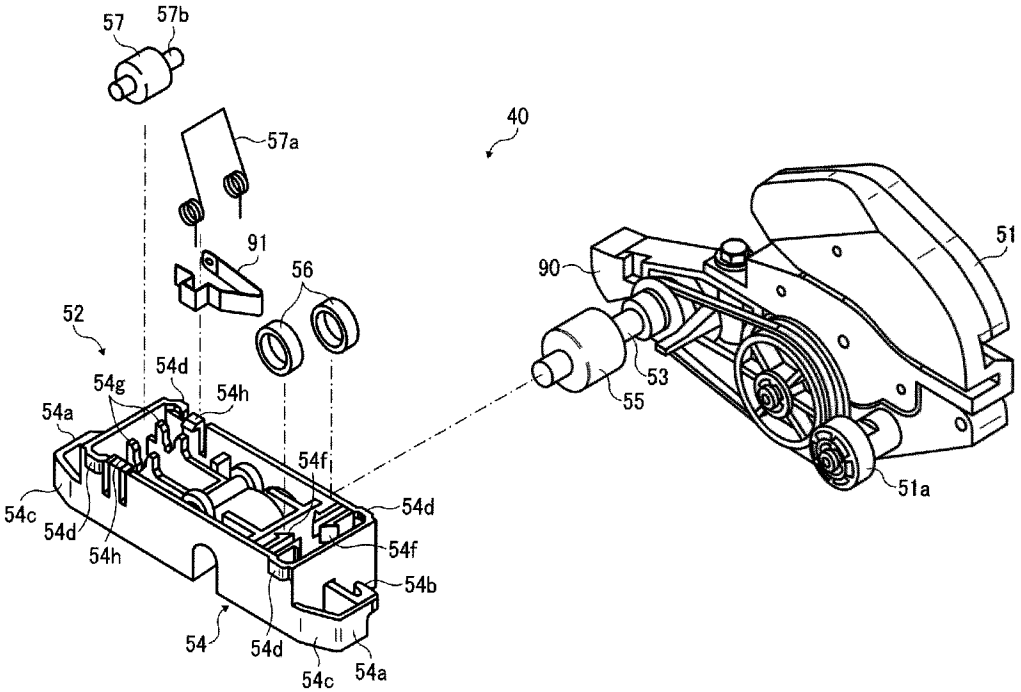
FIG. 14 is an exploded perspective view illustrating an example of a configuration of the movable member.

A description is now given of a detailed configuration and operation of the cutter casing 51 and the movable member 52 with reference to FIGS. 11 to 14. FIG. 11A is a rear perspective view of the cutter casing 51 and the movable member 52. FIG. 11B is a front perspective view of the cutter casing 51 and the movable member 52. FIG. 12 is an exploded perspective view of the cutter casing 51 and the movable member 52. FIG. 13 is a schematic view illustrating transmission of torque from the drive roller 55 to the cutter assembly 50. FIG. 14 is an exploded perspective view of the movable member 52.

As described previously, the cutter casing 51 has the bearing 51*b* that supports the rotary shaft 53. The bearing 51*b* is provided at a position lower than an accommodation position C of the cutter assembly 50 and downstream from the accommodation position C in the cutting direction, that is, the direction of outward movement of the cutter casing 51. The cutter casing 51 is rotatably coupled to the rotary shaft 53 via the bearing 51*b*.

The cutter casing 51 further includes a transmission member 80 that can transmit a torque to the cutter assembly 50. The transmission member 80 is constructed of a first pulley 81, a seamless belt 82, and a second pulley 83.

The first pulley 81 is mounted to the rotary shaft 53 to be rotated together with the rotary shaft 53. The second pulley 83 is rotatably mounted to a shaft 51*e* of the cutter casing 51. A gear portion 83*a* is formed in an upstream part of the second pulley 83 in the sheet conveyance direction to engage a gear, not shown, provided inside the cutter casing 51 so that the torque is transmitted to the cutter assembly 50. The seamless belt 82 is wound around the first and second pulleys 81 and 83.

During the outward movement of the movable member 52 in the sheet width direction, the drive roller 55 is rotated and the torque is transmitted from the drive roller 55 to the cutter assembly 50 via the rotary shaft 53, the first pulley 81, the seamless belt 82, and the second pulley 83, thereby rotating the circular blades 50*a* and 50*b*.

In addition to the body 54 and the drive roller 55, the movable member 52 further includes auxiliary rollers 56, a biasing roller 57, and a biasing member 57*a*.

The body 54 supports the rotary shaft 53 to rotatably hold the drive roller 55. The rotary shaft 53 is rotatably mounted to the bearing 51*b* of the cutter casing 51. The body 54 is disposed between the upper guide rail 61 and the upper guide plate 63 to be movable in the sheet width direction.

Protrusions 54*a* protruding outward to the upstream or downstream side in the cutting direction are formed at both upstream and downstream ends of the body 54, respectively. Each of the protrusions 54*a* has a hook 54*b* on which the wire 42 is hooked. It is to be noted that, in place of the wire 42, a timing belt may be used to pull the movable member 52. In such a case, both ends of the timing belt are fixed to the protrusions 54*a*, respectively. Compared to the wire 42, use of the timing belt can prevent slippage while pulling the movable member 52.

A sloped surface 54*c* sloping at a predetermined angle is formed in a lateral surface of each of the protrusions 54*a* opposite a lateral surface thereof in which the hook 54*b* is formed. The sloped surfaces 54*c* contact a lever of the microswitch, not shown. The microswitch is mounted on the first guide surface 63*a* of the upper guide plate 63 such that the lever of the microswitch contacts the sloped surface 54*c* of one of the protrusions 54 to detect presence of the movable member 52. Although being formed in the protrusions 54*a*, alternatively, the hooks 54*b* may be directly formed in the body 54 of the movable member 52. Further alternatively, the wire 42 may be directly mounted to the body 54 of the movable member 52.

The body 54 has the four contact portions 54*d* protruding outward from an upper portion of the lateral surfaces of the body 54 that face the first and second guide surfaces 63*a* and 63*b* of the upper guide plate 63, respectively. The contact portions 54*d* contact the first guide surface 63*a* and the second guide surface 63*b*, respectively, so as to prevent skew or swinging movement of the movable member 52 in the sheet conveyance direction during movement in the sheet width direction. Although being formed as protrusions, alternatively, the contact portions 54*d* may be formed as rollers, respectively.

The auxiliary rollers 56 are rotatably mounted to a pair of snap portions 54*f*, respectively. Although two separate auxiliary rollers are provided in the above-described example, alternatively, a single roller extending in the sheet conveyance direction may be used in place of the auxiliary rollers 56.

The biasing roller 57 has a shaft 57*b* and is rotatably mounted to bearings 54*g* via the shaft 57*b*. The shaft 57*b* of the biasing roller 57 is movably held within the bearings 54*g* in the vertical direction, and upward movement of the shaft 57*b* by a predetermined distance or more is prevented by engagement portions 54*h* respectively formed in an internal side of both lateral surfaces of the body 54 in the sheet conveyance direction. An upper end of each of the engagement portions 54*h* protrudes inward such that the engagement portions 54*h* are claw-shaped. Cutouts are formed on both sides of each of the engagement portions 54*h*, and an elastic member 91 is mounted to one of the engagement portions 54*h* as described in detail later.

The biasing member 57*a* is constructed of a double torsion-type coil spring. One end of the biasing member 57*a* is fixed to the body 54 and the other end of the biasing member 57*a*, which is a free end, contacts the shaft 57*b* of the biasing roller 57 from a portion below the biasing roller 57. As a result, the biasing member 57*a* biases the shaft 57*b* upward to press the biasing roller 57 against a lower surface of the upper guide plate 63. It is to be noted that, although the auxiliary rollers 56 are disposed on the upstream side and the biasing roller 57 is disposed on the downstream side in the cutting direction in the above-described example, alternatively, the positions of the auxiliary rollers 56 and the biasing roller 57 may be reversed.

Each of the auxiliary rollers 56 and the biasing roller 57 contacts the lower surface of the upper guide plate 63 while rotating.

Figure 15:
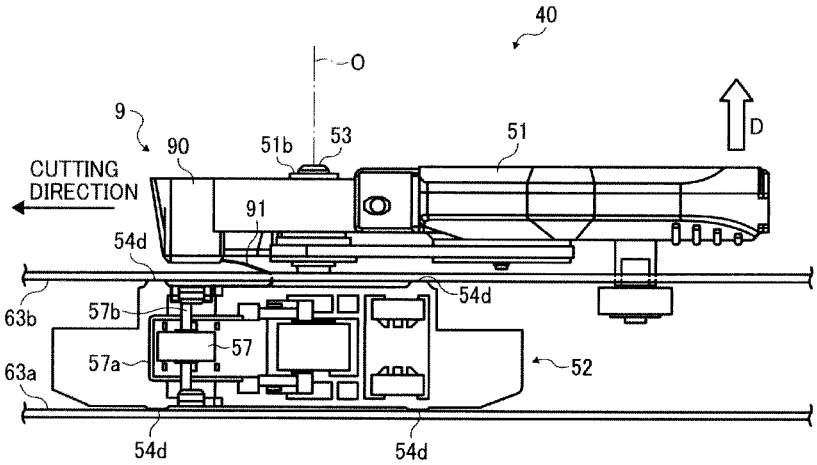
FIG. 15 is a top view illustrating the movable member held by a guide member.
Figure 16A:
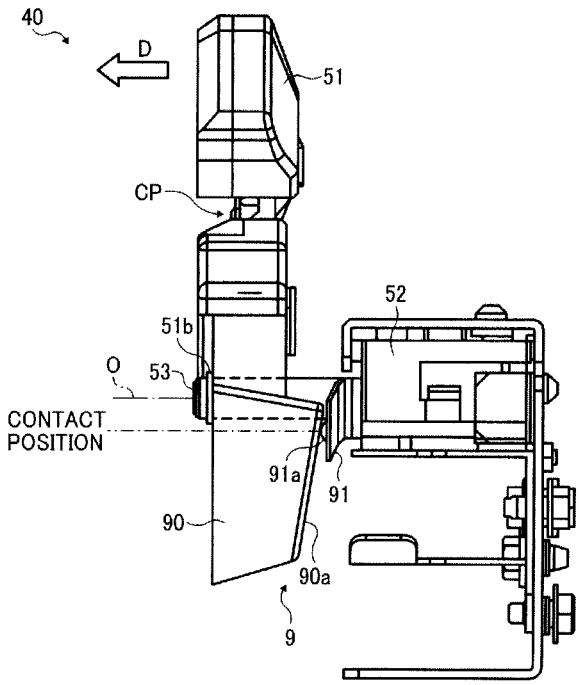
FIG. 16A is a front view illustrating the cutter unit during the outward movement.
Figure 16B:
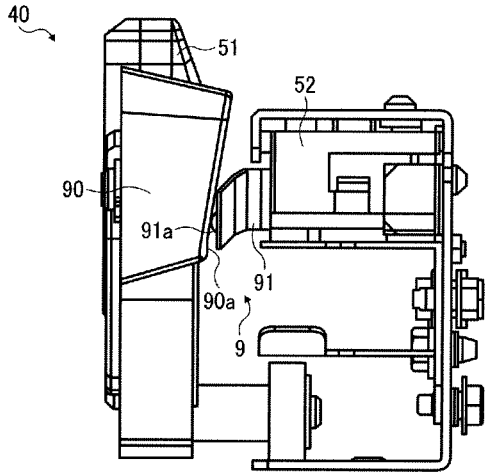
FIG. 16B is a front view illustrating the cutter unit during the homeward movement.
Figure 17A:
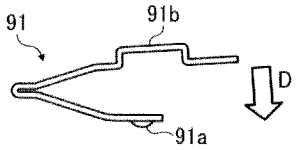
FIG. 17A is a schematic view illustrating an example of a configuration of an elastic member.
Figure 17B:
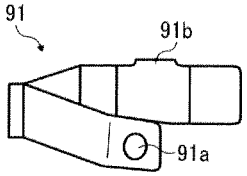
FIG. 17B is a perspective view illustrating the elastic member.
Figure 18A:
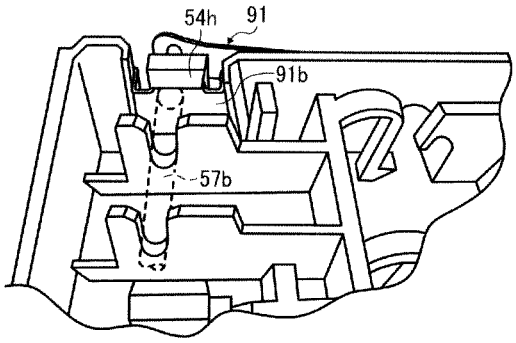
FIG. 18A is a partial perspective view illustrating relative positions of the elastic member and a shaft of a biasing roller.
Figure 18B:
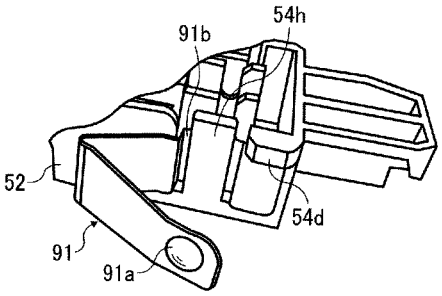
FIG. 18B is an enlarged perspective view illustrating the elastic member.

A description is now given of a configuration that prevents displacement of the cutter casing 51 during cutting of the sheet 30 with reference to FIGS. 15 to 18B. FIG. 15 is a top view illustrating the movable member 52 held by the upper guide plate 63 of the guide member 41. FIG. 16A is a front view illustrating the cutter unit 40 during the outward movement. FIG. 16B is a front view illustrating the cutter unit 40 during the homeward movement. FIG. 17A is a schematic view illustrating the elastic member 91. FIG. 17B is a perspective view illustrating the elastic member 91. FIG. 18A is a partial perspective view illustrating relative positions of the elastic member 91 and the shaft 57*b* of the biasing roller 57. FIG. 18B is an enlarged perspective view illustrating the elastic member 91.

A receiver 90 is provided at an end of the cutter casing 51 in the cutting direction. Specifically, the receiver 90 is provided downstream from the rotary shaft 53 in the cutting direction and has a receiving surface 90*a* that faces the movable member 52. The receiving surface 90*a* is sloped such that a bottom portion thereof is gradually separated from the movable member 52 in a direction indicated by arrow D in FIG. 16A, and is contacted by the elastic member 91 provided to the movable member 52. The elastic member 91 is constructed of a metal leaf spring folded at an intermediate portion thereof and is provided downstream from the rotary shaft 53 in the cutting direction.

The elastic member 91 is kept contacting the receiving surface 90*a* of the receiver 90 in both states in which the cutter casing 51 is positioned as illustrated in FIG. 16A during the cutting of the sheet 30 and is retracted from the sheet conveyance path as illustrated in FIG. 16B so as to apply an elastic force to the receiver 90 in the direction D away from the movable member 52. When the cutter casing 51 is positioned to cut the sheet 30 as illustrated in FIG. 16A, the receiver 90 and the elastic member 91 are transformed to a displacement restriction state in which displacement of the cutter casing 51 during cutting of the sheet 30 is restricted. When the cutter casing 51 is retracted from the sheet conveyance path as illustrated in FIG. 16B, the receiver 90 and the elastic member 91 are transformed to a released state in which restriction of displacement of the cutter casing 51 is released.

Change in an amount of elastic force applied from the elastic member 91 to the receiving surface 90*a* based on the rotation of the cutting casing 51 transforms the receiver 90 and the elastic member 91 between the displacement restriction state and the released state.

In the present illustrative embodiment, the receiving surface 90*a* is sloped such that a distance between the receiving surface 90*a* of the receiver 90 and the movable member 52 differs between the displacement restriction state and the released state. As a result, the elastic force of the elastic member 91 acting on the receiving surface 90*a* reaches the maximum amount in the displacement restriction state. In other words, the elastic member 91 applies the maximum elastic force to the receiver 90 in the direction D away from the movable member 52 in the displacement restriction state. Thus, the maximum elastic force acts on the cutter casing 51 in the displacement restriction state to restrict displacement of the cutter casing 51.

The elastic member 91 has a spherical contact portion 91*a* bulging in the direction D at a leading end thereof, that is, a free end thereof. As illustrated in FIG. 16A, upon contact of the elastic member 91 against the receiving surface 90*a*, the contact portion 91*a* of the elastic member 91 contacts the receiving surface 90*a* at a point. At this time, the receiving surface 90*a* is contacted by the contact portion 91*a* at a contact position below the central axis O of the rotary shaft 53. It is to be noted that, the shape of the contact portion 91*a* is not limited to a sphere as long as the contact portion 91*a* contacts the receiving surface 90*a* at a point.

The elastic member 91 further has a bent portion 91*b* bent outward in a direction opposite the direction Data base end thereof. The bent portion 91*b* is mounted to the engagement portion 54*h* of the movable member 52 as illustrated in FIGS. 18A and 18B. Specifically, the bent portion 91*b* contacts the engagement portion 54*h* from the interior of the body 54 of the movable member 52, and an upper edge of the bent portion 91*b* contacts the claw-shaped engagement portion 54*h* from a portion below the engagement portion 54*h*. A leading portion of the base end of the elastic member 91 contacts the contact portion 54*d* from the exterior of the body 54 below the contact portion 54*d*. Thus, the elastic member 91 is mounted to the movable member 52 via the bent portion 91*b*. The bent portion 91*b* is positioned between the shaft 57*b* of the biasing roller 57 and the engagement portion 54*h* across a range of movement of the shaft 57*b*. Accordingly, the vertical movement of the shaft 57*b* is not hindered by the bent portion 91*b*.

The elastic member 91 is angled such that the free end thereof is positioned below the base end thereof as illustrated in FIG. 17B. As a result, the contact portion 91*a* presses a bottom portion of the receiving surface 90*a*. In the present illustrative embodiment, the receiver 90 and the elastic member 91 together form a restriction unit 9.

A description is now given of operation of the restriction unit 9 with reference to FIGS. 15, 16A, and 16B.

FIGS. 15 and 16A illustrate a state in which the cutter unit 40 cuts the sheet 30 during the outward movement and the receiver 90 and the elastic member 91 are in the displacement restriction state. By contrast, FIG. 16B illustrates a state during the homeward movement of the cutter unit 40 and the receiver 90 and the elastic member 91 are in the released state. The cutter assembly 50 cuts the sheet 30 at a cutting position CP where the cutter assembly 50 contacts the sheet 30.

During the cutting of the sheet 30, the contact portion 91*a* of the elastic member 91 contacts the receiving surface 90*a* as illustrated in FIG. 16A. At this time, the elastic member 91 presses the receiving surface 90*a* in the direction D away from the movable member 52 with its maximum elastic force. In addition, the receiving surface 90*a* is contacted by the contact portion 91*a* at the contact position below the central axis O of the rotary shaft 53. As described previously, the elastic member 91 is provided downstream from the rotary shaft 53 in the cutting direction. Accordingly, torque acts on the cutter casing 51 in the direction opposite the direction D during the cutting of the sheet 30. Specifically, the torque acts on the cutter casing 51 such that the cutting position CP of the cutter unit 40 is rotated in the direction opposite the direction D around the bearing 51*b* of the cutter casing 51.

As a result, displacement and skew of the cutter casing 51 in the direction D away from the movable member 52 are restricted. Thus, displacement of the cutter casing 51 is restricted during the cutting of the sheet 30. It is to be noted that, displacement of the cutter casing 51 also includes skew of the cutter casing 51 in the direction D away from the movable member 52.

After the cutting of the sheet 30, the cutter casing 51 is rotated as illustrated in FIG. 16B. Because the receiving surface 90*a* is sloped in the direction D away from the movable member 52, the distance between the receiving surface 90 and the movable member 52 is increased as the cutter casing 51 rotates. Accordingly, the elastic force of the elastic member 91 acting on the receiving surface 90*a* is gradually decreased as the cutter casing 51 rotates, and ultimately, hardly acts on the receiving surface 90*a* even though the receiving surface 90*a* and the contact portion 91*a* contact each other. At this time, alternatively, the receiving surface 90*a* and the contact portion 91*a* may not contact each other such that the elastic force of the elastic member 91 does not act on the receiving surface 90*a*.

Because the cutter assembly 50 does not cut the sheet 30 during the homeward movement of the cutter casing 51, displacement of the cutter casing 51 need not be restricted. Thus, the elastic force of the elastic member 91 need not act on the receiving surface 90*a*. By contrast, upon cutting of the sheet 30 during the outward movement of the cutter casing 51, the elastic force of the elastic member 91 is caused to act on the receiving surface 90*a* to restrict displacement of the cutter casing 51. The receiving surface 90*a* is sloped such that the elastic force of the elastic member 91 acting on the receiving surface 90*a* is gradually increased or decreased during the rotation of the cutter casing 51, thereby reducing resistance during the rotation of the cutter casing 51.

As described above, the sheet cutting device 5 according to the present illustrative embodiment includes the restriction unit 9 constructed of the receiver 90 and the elastic member 91 that restricts displacement of the cutter casing 51 caused by cutting load during the cutting of the sheet 30. As a result, improper cutting of the sheet 30 caused by displacement of the cutter casing 51 can be prevented with the uncomplicated configuration including the receiver 90 and the elastic member 91.

In addition, change in the elastic force of the elastic member 91 applied to the receiving surface 90*a* of the receiver 90 transforms the receiver 90 and the elastic member 91 between the displacement restriction state and the released state based on the rotation of the cutting casing 51. Accordingly, the elastic force of the elastic member 91 acts on the receiving surface 90*a* only during the cutting of the sheet 30 to restrict displacement of the cutter casing 51. As a result, the elastic force of the elastic member 91 does not become a burden upon rotation of the cutter casing 51. Thus, the sheet cutting device 5 according to the present illustrative embodiment can reduce load during the rotation of the cutter casing 51.

The receiving surface 90*a* is sloped as described above so that load caused by steps or the like does not occur between the receiving surface 90*a* and the contact portion 91*a* of the elastic member 91 during the rotation of the cutter casing 51. Therefore, the transformation between the displacement restriction state and the released state can be smoothly performed.

The contact portion 91*a* of the elastic member 91 and the receiving surface 90*a* of the receiver 90 contact each other at a point so that the elastic member 91 can reliably contact the sloped receiving surface 90*a*. Further, the edges of the elastic member 91 does not contact the receiving surface 90*a* during the rotation of the cutter casing 51, thereby smoothly transforming the receiver 90 and the elastic member 91 between the displacement restriction state and the released state.

Although the receiver 90 and the elastic member 91 are used for restricting displacement of the cutter casing 51 during the cutting of the sheet 30 in the above-described example, the configuration of the restriction unit 9 is not limited thereto, as described in detail below as a variation of the present illustrative embodiment.

Figure 19:
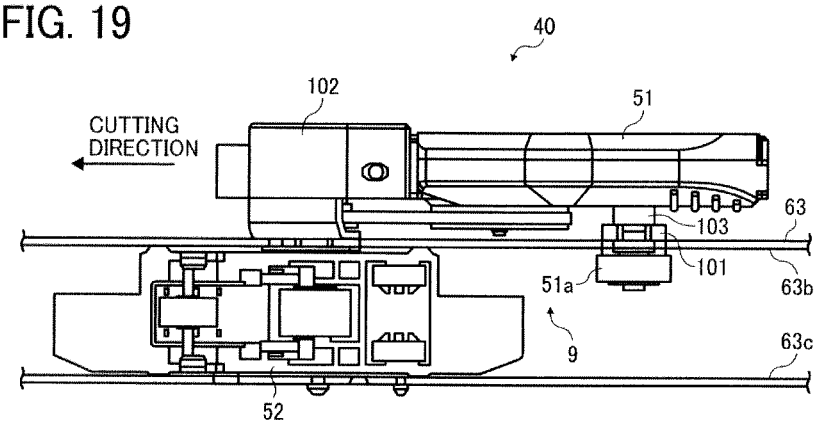
FIG. 19 is a top view illustrating an example of a configuration of a cutter unit according to a variation.
Figure 20:
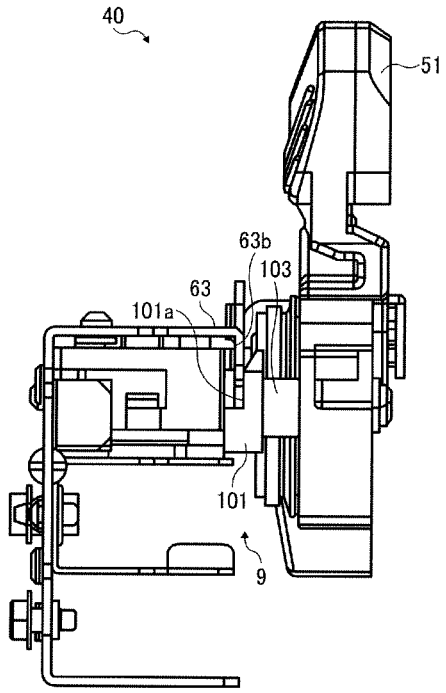
FIG. 20 is a schematic view illustrating an example of a configuration of a first displacement restriction member included in the cutter unit according to the variation.
Figure 21:
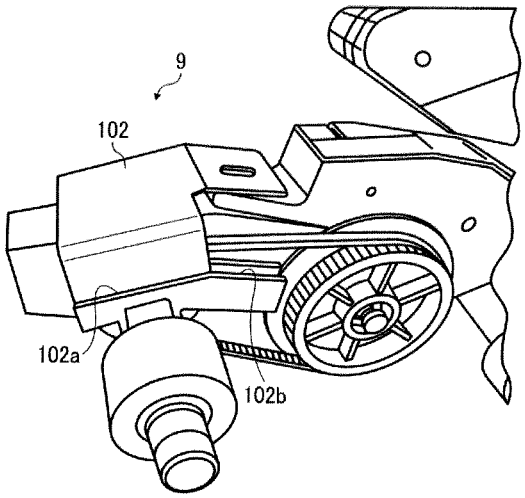
FIG. 21 is a perspective view illustrating an example of a configuration of a second displacement restriction member included in the cutter unit according to the variation.
Figure 22A:
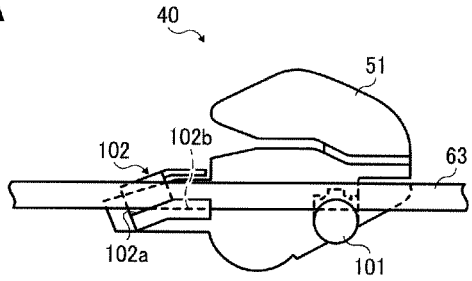
FIG. 22A is a schematic view illustrating relative positions of the first and second displacement restriction members and an upper guide plate of the guide member during the outward movement of the cutter unit.
Figure 22B:
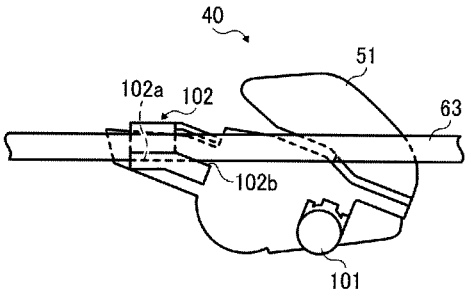
FIG. 22B is a schematic view illustrating relative positions of the first and second displacement restriction members and the upper guide plate of the guide member during the homeward movement of the cutter unit.

A description is now given of a configuration and operation of the sheet cutting device 5 according to the variation of the illustrative embodiment with reference to FIGS. 19 to 22B. FIG. 19 is a top view illustrating an example of a configuration of the cutter unit 40 according to the variation. FIG. 20 is a schematic view illustrating an example of a configuration of a first displacement restriction member 101 included in the cutter unit 40 according to the variation. FIG. 21 is a perspective view illustrating an example of a configuration of a second displacement restriction member 102 included in the cutter unit 40 according to the variation. FIG. 22A is a schematic view illustrating relative positions of the first and second displacement restriction members 101 and 102 and the upper guide plate 63 during the outward movement of the cutter unit 40. FIG. 22B is a schematic view illustrating relative positions of the first and second displacement restriction members 101 and 102 and the upper guide plate 63 during the homeward movement of the cutter unit 40.

The cutter unit 40 according to the variation includes the first displacement restriction member 101 and the second displacement restriction member 102, both of which are formed of resin. In the variation, the first displacement restriction member 101 and the second displacement restriction member 102 together form the restriction unit 9.

The first displacement restriction member 101 is fixedly mounted to a boss 103 having a shaft that rotatably supports the driven roller 51*a*. As illustrated in FIG. 20, the first displacement restriction member 101 includes a recessed portion 101*a* that sandwiches the upper guide plate 63 having the second guide surface 63*b* from below the upper guide plate 63. Accordingly, when the cutter casing 51 is located within the cutting range, the recessed portion 101*a* of the first displacement restriction member 101 sandwiches the upper guide plate 63. The recessed portion 101*a* is tapered upward to reliably sandwich the upper guide plate 63 when the cutter casing 51 is rotated to the state illustrated in FIG. 22A. As a result, the upper guide plate 63 is reliably sandwiched by the recessed portion 101*a* during the rotation of the cutter casing 51 to prevent displacement of the cutter casing 51 caused by parts tolerance or the like.

The second displacement restriction member 102 is fixed to the cutter casing 51 via a fastening member. It is to be noted that, alternatively, the second displacement restriction member 102 may be formed together with the cutter casing 51 as a single integrated unit. The second displacement restriction member 102 includes a first recessed portion 102*a* and a second recessed portion 102*b*, each of which sandwiches the upper guide plate 63 at a portion between the cutter casing 51 and the movable member 52. As illustrated in FIG. 22B, the first recessed portion 102*a* sandwiches the upper guide plate 63 during the homeward movement of the cutter unit 40. As illustrated in FIG. 22A, when the cutter casing 51 is located within the cutting range, the second recessed portion 102*b* of the second displacement restriction member 102 sandwiches the upper guide plate 63. Thus, the second displacement restriction member 102 constantly sandwiches the upper guide plate 63 using the first or second recessed portion 102*a* or 102*b* even when the cutter casing 51 is rotated. As a result, the upper guide plate 63 is reliably sandwiched by the first or second recessed portion 102*a* or 102*b* to prevent displacement of the cutter casing 51 due to parts tolerance or the like during the rotation of the cutter casing 51. Similar to the recessed portion 101*a* of the first displacement restriction member 101, each of the first and second recessed portions 102*a* and 102*b* of the second displacement restriction member 102 may be tapered upward.

The variation can achieve the same effects as those achieved by the illustrative embodiment.

Although being retracted downward in the above-described example, the cutter casing 51 may be retracted in the sheet thickness direction depending on the skew of the sheet cutting device 5 in a case in which the sheet cutting device 5 is not disposed horizontally relative to the body 1*a* of the image forming apparatus 1. Further alternatively, the cutter casing 51 may be retracted upward. In such a case, the guide member 41 is disposed above the sheet conveyance path, the outward path of the cutter casing 51 is formed on the lower guide rail 62, and the homeward path of the cutter casing 51 is formed on the upper guide rail 61. After the cutter casing 51 has passed through the outward path during cutting of the sheet 30, the driven roller 51*a* is moved to the upper guide rail 61 by a mechanism that corresponds to the transition mechanism 70. Accordingly, the cutter casing 51 retracted from the sheet conveyance path can be moved through the homeward path. After the cutter casing 51 has passed through the homeward path, the driven roller 51*a* is moved to the lower guide rail 62 through a passage that corresponds to the first passage 61*c* to be ready for the next cutting operation. The above-described alternative configuration can achieve the same effects as those achieved by the present illustrative embodiment.

Elements and/or features of different illustrative embodiments may be combined with each other and/or substituted for each other within the scope of this disclosure and appended claims.

Illustrative embodiments being thus described, it will be apparent that the same may be varied in many ways. Such exemplary variations are not to be regarded as a departure from the scope of the present invention, and all such modifications as would be obvious to one skilled in the art are intended to be included within the scope of the following claims.

The number of constituent elements and their locations, shapes, and so forth are not limited to any of the structure for performing the methodology illustrated in the drawings.

What is claimed is:

1. A sheet cutting device to cut a sheet conveyed through a conveyance path to a predetermined length, comprising:

a cutter casing movable in a sheet width direction perpendicular to a sheet conveyance direction while retracted from the sheet conveyance path in a sheet thickness direction after cutting of the sheet, the cutter casing accommodating a pair of blades disposed opposite each other with the sheet interposed therebetween;

a movable member separate from the cutter casing in the sheet conveyance direction and movable in the sheet width direction;

a connection member to connect the cutter casing and the movable member, the connection member having a central axis around which the cutter casing is rotated relative to the movable member in the sheet thickness direction; and a restriction unit to transform a state of the cutter casing based on rotation of the cutter casing between a displacement restriction state in which displacement of the cutter casing is restricted during the cutting of the sheet and a released state in which the restriction of displacement of the cutter casing is released while the cutter casing is retracted from the sheet conveyance path in the sheet thickness direction.

2. The sheet cutting device according to claim 1, wherein the restriction unit comprises an elastic member provided to the movable member and causing an elastic force thereof to act on the cutter casing in the displacement restriction state to restrict displacement of the cutter casing.

3. The sheet cutting device according to claim 2, wherein the restriction unit further comprises a receiver provided to the cutter casing and having a receiving surface contacted by the elastic member, wherein a distance between the receiving surface of the receiver and the movable member differs between the displacement restriction state and the released state.

4. The sheet cutting device according o claim 3, wherein the receiving surface of the receiver is sloped in a direction away from the movable member.

5. The sheet cutting device according to claim 3, wherein the elastic member contacts the receiving surface of the receiver in both the displacement restriction state and the released state.

6. The sheet cutting device according to claim 3, wherein the elastic member comprises a contact portion that contacts the receiving surface of the receiver at a point.

7. The sheet cutting device according to claim 3, wherein the receiving surface of the receiver and the elastic member contact each other at a portion below the central axis of the connection member.

8. The sheet cutting device according to claim 1, wherein the restriction unit is disposed downstream from the connection member in a direction of movement of the cutter casing during the cutting of the sheet.

9. An image forming apparatus comprising:

an image forming unit to form an image on a sheet;

a sheet cutting device disposed downstream from the image forming n in a sheet conveyance direction to cut the sheet having an image formed by the image forming unit thereon to a predetermined length; and a sheet conveyance unit to convey the sheet having the image thereon to the sheet cutting device through a sheet conveyance path, the sheet cutting device comprising:

a cutter casing movable in a sheet width direction perpendicular to the sheet conveyance direction while retracted from the sheet conveyance path in a sheet thickness direction after cutting of the sheet, the cutter casing accommodating a pair of blades disposed opposite each other with the sheet interposed therebetween;

a movable member separate from the cutter casing in the sheet conveyance direction and being movable in the sheet width direction;

a connection member to connect the cutter casing and the movable member, the connection member having a central axis around which the cutter casing is rotated relative to the movable member in the sheet thickness direction; and a restriction unit to transform a state of the cutter casing based on rotation of the cutter casing between a displacement restriction state in which displacement of the cutter casing is restricted during the cutting of the sheet and a released state in which the restriction of displacement of the cutter casing is released while the cutter casing is retracted from the sheet conveyance path in the sheet thickness direction.

* * * * *